US006769883B2

(12) United States Patent
Brid et al.

(10) Patent No.: US 6,769,883 B2
(45) Date of Patent: Aug. 3, 2004

(54) FAN WITH MOTOR VENTILATION SYSTEM

(75) Inventors: Gregory Michael Brid, Colliersville, TN (US); James C. Thomas, Jr., Germantown, TN (US)

(73) Assignee: Hunter Fan Company, Memphis, TN (US)

( * ) Notice: Subject to any disclaimer, the term of this patent is extended or adjusted under 35 U.S.C. 154(b) by 83 days.

(21) Appl. No.: 10/303,237

(22) Filed: Nov. 23, 2002

(65) Prior Publication Data

US 2004/0101423 A1 May 27, 2004

(51) Int. Cl.[7] ..... F04B 39/06; H04B 35/04; B63H 1/26

(52) U.S. Cl. ..... 417/368; 417/423.1; 417/423.8; 416/5; 416/235; 310/63

(58) Field of Search ..... 417/368, 423.1, 417/423.8; 310/63; 416/5, 228, 235, 237

(56) References Cited

U.S. PATENT DOCUMENTS

| | | | | | |
|---|---|---|---|---|---|
| 4,055,113 | A | * | 10/1977 | Monroe | 454/348 |
| 5,405,243 | A | * | 4/1995 | Hurley et al. | 416/189 |
| 5,967,764 | A | * | 10/1999 | Booth et al. | 417/423.8 |
| 6,438,322 | B1 | * | 8/2002 | Reiker | 392/364 |
| 6,631,243 | B2 | * | 10/2003 | Reiker | 392/364 |

* cited by examiner

*Primary Examiner*—Charles G. Freay
(74) *Attorney, Agent, or Firm*—Baker Donelson

(57) ABSTRACT

A fan (10) is disclosed having a downrod (11), a motor (12), a motor housing (13) substantially encasing the motor (12), and blades (14) mounted to the motor housing (13). Each blade (14) has an air intake scoop (16 adjacent to and extending from the motor housing (13). The interior space (17) created by the intake scoop (16) is in fluid communication with an opening (18) extending through the motor housing (13). Rotational movement of the air intake scoops (16) create airstreams which are directed to the electric motor for ventilation purposes.

12 Claims, 3 Drawing Sheets

FAN WITH MOTOR VENTILATION SYSTEM

TECHNICAL FIELD

This invention relates generally to fans, and more particularly to the blade design of a fan and the manner in which a ceiling fan motor is vented.

BACKGROUND OF THE INVENTION

Many different types of electrical fans have existed for years. Today's fans, and especially today's ceiling fans, typically have an electric motor encased within a housing with an opening through which blade irons extend and are mounted to the electric motor. A blade is coupled to each blade iron so that operation of the electric motor causes rotational movement of the blade irons and their associated blades, thereby creating an airflow.

A problem associated with electric motors of fans has been the heat produced by such. In most ceiling fans, the stationary housing encasing the electric motor is provided with ventilation holes which allow the heat created by the electric motor to be vented. However, to be aesthetically pleasing these ventilation holes are usually designed to be small and inconspicuous in order not to detract from the aesthetics of the motor housing. As such, these venting holes have proven to be insufficient, or at least minimally acceptable, in maintaining the motor in a cool state.

Accordingly, it is seen that a need remains for a fan having an air ventilation system that can maintain the electric motor in a cool state. It is to the provision of such therefore that the present invention is primarily directed.

SUMMARY OF THE INVENTION

In a preferred form of the invention a fan comprises an electric motor, a housing at least partially surrounding the electric motor and coupled to the electric motor for rotational movement through operation of the electric motor, the housing having an opening there through, a plurality of blades coupled to the housing for rotational movement, and at least one an air intake scoop. The air intake scoop is in fluid communication with the housing opening. With this construction, rotational movement of the air intake scoop causes air to be drawn into the air intake scoop and passed through the housing opening so as to vent the motor mounted within the housing.

In another preferred form of the invention a method of cooling an electric motor of a fan comprises the steps of providing an electric motor, a housing at least partially surrounding the electric motor and having at least one air flow opening there through, a plurality of blades coupled to the motor for rotational movement, and at least one air intake scoop coupled to the housing and in fluid communication with said housing air flow opening. The air intake scoop is then rotated through operation of the electric motor so as to capture air within the rotating scoop and forcing an airstream through the housing air flow opening.

DETAILED DESCRIPTION

Figure 1:
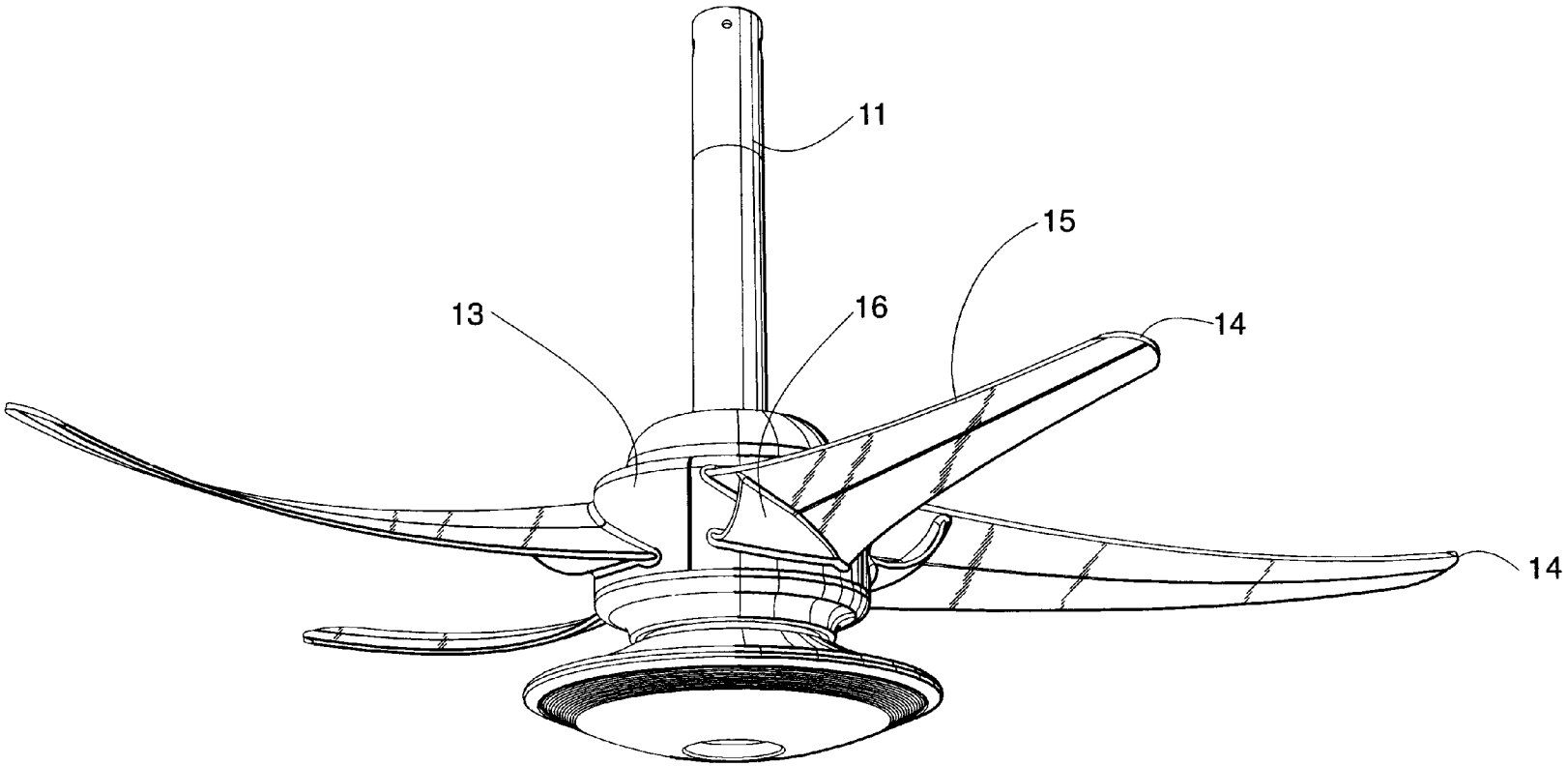
FIG. 1 is a perspective view of a ceiling fan embodying principles of the invention in a preferred form.
Figure 2:
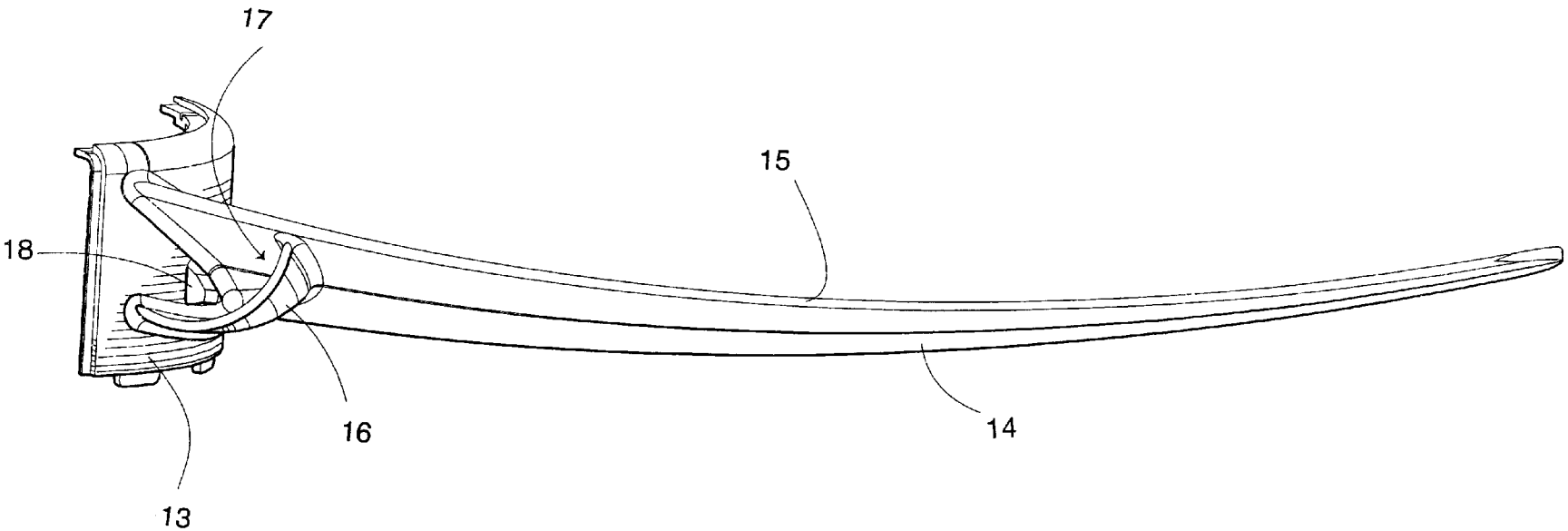
FIG. 2 is a perspective view of the blade of the ceiling fan of FIG. 1.
Figure 3:
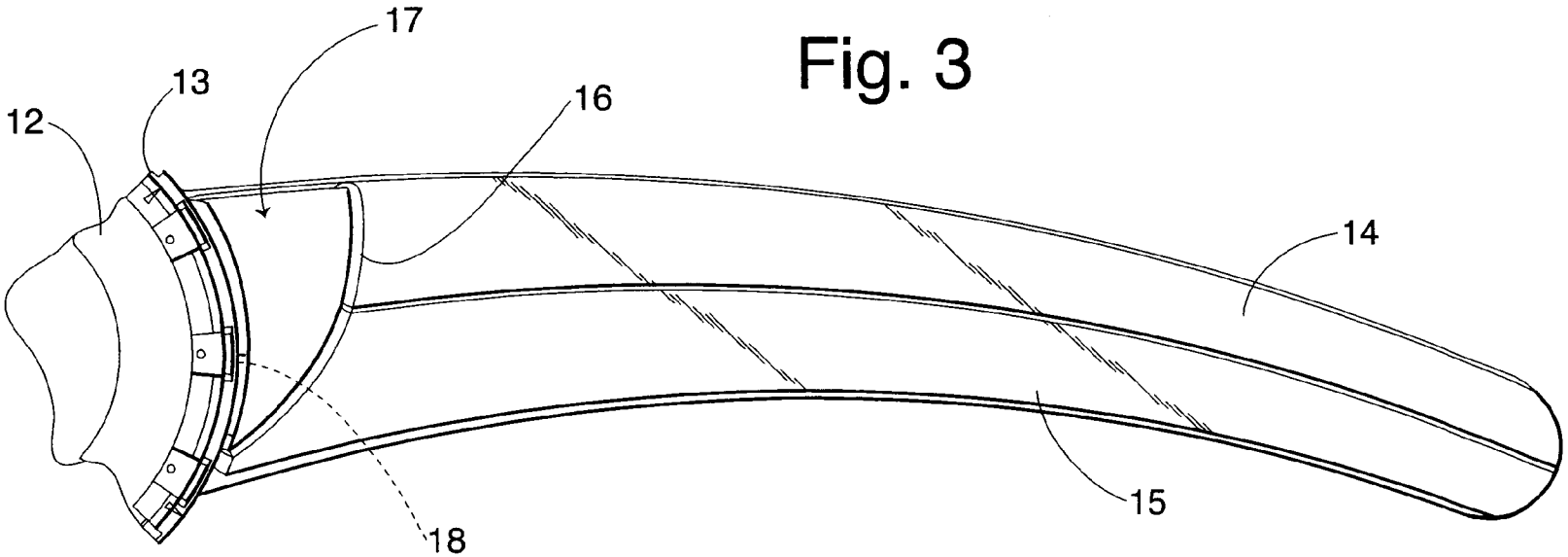
FIG. 3 is a bottom view of the blade of FIG. 2.

With reference next to the drawings, there is shown a ceiling fan 10 having a downrod 11 adapted to be coupled to a ceiling, a motor 12 coupled to a lower end of the downrod 11, a motor housing 13 substantially encasing the motor 12, and four blades 14 mounted to the motor housing 13. The motor 12 is coupled to a conventional power supply in conventional fashion.

Each blade 14 has an elongated, main blade portion 15 and an air intake scoop 16 extending between from the motor housing 13 and the bottom surface of the main blade portion 15. The interior space 17 created by the intake scoop 16 is in fluid communication with an opening 18 extending through the motor housing 13.

It should be understood that the particular features of ceiling fan 10 do not form a part of the present invention and are shown by way of illustration, not of limitation. For instance, as discussed subsequently, the ceiling fan 10 of the preferred embodiment includes an "inside-out" electric motor, i.e., ones in which the rotor is disposed radially outward of the stator. However, the motor may also be a "standard configuration" electric motor, i.e., one in which the rotor is disposed radially inward of the stator. With the inside-out electric motor the externally mounted rotor may be coupled to the motor housing 13 so that the motor housing also rotates when the electric motor is energized.

In use, the electric motor 12 is energized to cause the rotation of the motor housing 13 and the blades 14 mounted to the motor housing 13. The forward movement of the blades 14 and their air intake scoops 16 cause air to be forced into and captured within the space 17 within the rotating air intake scoops 16. The captured air escapes through the housing opening 18, thereby creating a constant airstream that flow from the air intake scoops 16, through the housing openings 18 and onto the motor 12 encased within the housing 13. These airstreams created by the movement of the air intake scoops ventilate the encased electric motor 12 with a positive air stream, thereby maintaining the electric motor in a cool state. As such, the rotating air scoops in fluid communication with the housing openings may be considered a ventilation system for the fan motor.

It should be understood that the air intake scoop 16 may be positioned along any portion of the blade. The air intake scoops may also be designed to direct an airstream upwardly or downwardly depending upon the position of the blades or scoops relative to the electric motor. For instance, with a ceiling fan having the blades positioned below the electric motor the air intake scoops may direct the airstreams upwardly and through venting holes in the bottom of the motor housing, regardless of whether or not the motor housing also rotates. Alternatively, the air intake scoops 16 may be positioned upon the housing in positions independent from the blades, i.e., the air intake scoops may be a separate structure from the blades. The number of air intake scoops may also be different from the number of blades. In fact, the fan may include just one air intake scoop, although this is not preferred as multiple air scoops may be positioned to provide a proper balance and as multiple air scoops provide better and a more thorough ventilation of the electric motor.

It should be understood that the term motor housing used herein is meant to describe any structure that at least partially encases or surrounds the motor. As such, a root portion of a ceiling fan blade that forms a partial enclosure about the motor may be considered to be a housing.

Also, it should be understood that the just described invention is not limited to applications relating to ceiling fans. The concept embodied by the invention may be applied to any type of fan having a generally centrally positioned electric motor.

It thus is seen that a fan is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A ceiling fan comprising:

an electric motor;

a housing at least partially surrounding said electric motor and coupled to said electric motor for rotational movement through operation of said electric motor, said housing having at least one opening there through; and a plurality of blades coupled to said housing for rotational movement, at least one said blade having an air intake scoop, said air intake scoop being in fluid communication with said housing opening, whereby rotational movement of the blade causes air to be drawn into the air intake scoop and passed through the housing opening so as to vent the motor mounted within the housing.

2. The ceiling fan of claim 1 wherein said housing has a plurality of openings and wherein each said blade has an air intake scoop and each said air intake scoop is in fluid communication with one said housing opening.

3. The fan of claim 1 wherein said plurality of blades are coupled to said electric motor through said housing.

4. A fan comprising:

an electric motor;

a housing at least partially surrounding said electric motor, said housing having an opening there through;

a plurality of blades coupled to said electric motor for rotational movement; and at least one an air intake scoop, said air intake scoop being in fluid communication with said housing opening, whereby rotational movement of the air intake scoop causes air to be drawn into the air intake scoop and passed through the housing opening so as to vent the motor mounted within the housing.

5. The fan of claim 3 wherein said air intake scoop extends from said blade.

6. The fan of claim 3 wherein each said blade has one said air intake scoop coupled thereto.

7. The fan of claim 3 wherein said fan is a ceiling fan.

8. A fan comprising:

an electric motor;

a housing at least partially surrounding said electric motor, said housing having a plurality of openings there through;

a plurality of blades coupled to said electric motor for rotational movement; and a plurality of air intake scoops, each said air intake scoop being in fluid communication with one said housing opening, whereby rotational movement of the air intake scoop causes air to be drawn into the air intake scoop and passed through the housing opening so as to vent the motor mounted within the housing.

9. The fan of claim 8 wherein said air intake scoop extends from said blade.

10. The fan of claim 8 wherein said fan is a ceiling fan.

11. The fan of claim 8 wherein said plurality of blades are coupled to said electric motor through said housing.

12. A method of cooling an electric motor of a fan comprising the steps of:

(a) providing an electric motor;

(b) providing a housing at least partially surrounding the electric motor and having at least one air flow opening there through;

(c) providing a plurality of blades coupled to the motor for rotational movement;

(d) providing at least one air intake scoop coupled to the housing and in fluid communication with said housing air flow opening;

(e) rotating said air intake scoop through operation of the electric motor so as to capture air within the rotating scoop and forcing an airstream through the housing air flow opening.

* * * * *